United States Patent [19]

Meierhoefer

[11] 4,125,186

[45] Nov. 14, 1978

[54] PHARMACEUTICAL DELIVERY SYSTEM

[75] Inventor: Eugene J. Meierhoefer, Hackettstown, N.J.

[73] Assignee: Warner-Lambert Company, Morris Plains, N.J.

[21] Appl. No.: 885,154

[22] Filed: Mar. 10, 1978

Related U.S. Application Data

[63] Continuation of Ser. No. 818,042, Jul. 22, 1977, abandoned, which is a continuation of Ser. No. 615,450, Sep. 22, 1975, abandoned.

[51] Int. Cl.[2] ..... B65D 25/08

[52] U.S. Cl. ..... 206/221; 128/272.1; 206/438; 215/1 C; 215/100 A; 215/DIG. 8

[58] Field of Search ..... 206/438, 219, 221, 222; 215/1 C, DIG. 3, DIG. 8, 1 R, 100 A, 32, 355, 31; 259/48, 60; 128/272, 272.1, 272.3

[56] References Cited

U.S. PATENT DOCUMENTS

| | | | |
|---|---|---|---|
| 2,610,628 | 9/1952 | Lockhart | 206/221 |
| 2,636,493 | 4/1953 | Lockhart | 206/221 |
| 2,788,002 | 4/1957 | Hinson et al. | 206/222 |
| 2,798,488 | 7/1957 | Hall | 259/48 |
| 3,064,802 | 11/1962 | Jess et al. | 206/219 |
| 3,083,858 | 4/1963 | Biedenstein | 215/1 C |
| 3,171,412 | 3/1965 | Braun | 215/1 C |
| 3,202,324 | 8/1965 | Honnet et al. | 215/100 R |
| 3,232,495 | 2/1966 | Schneider | 215/1 C |
| 3,509,879 | 5/1970 | Bathish et al. | 215/32 |
| 3,684,455 | 8/1972 | Vacirca et al. | 206/219 |
| 3,788,369 | 1/1974 | Killinger | 128/272.3 |
| 3,921,630 | 11/1975 | McPhee | 128/272 |
| 3,948,261 | 4/1976 | Steiner | 215/DIG. 3 |

*Primary Examiner*—William I. Price
*Assistant Examiner*—Bruce H. Bernstein
*Attorney, Agent, or Firm*—Albert H. Graddis; Frank S. Chow; George M. Yahwak

[57] ABSTRACT

This invention relates to a single use container package especially adapted for use as a pharmaceutical delivery system. It is a two unit package comprising a liquid containing bottle and an open ended pharmaceutical capsule.

5 Claims, 5 Drawing Figures

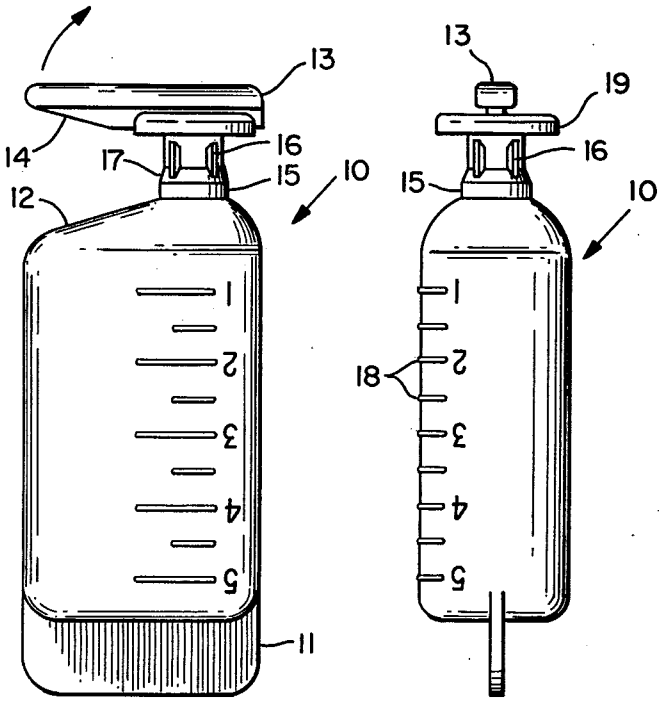
FIG. 1
FIG. 2
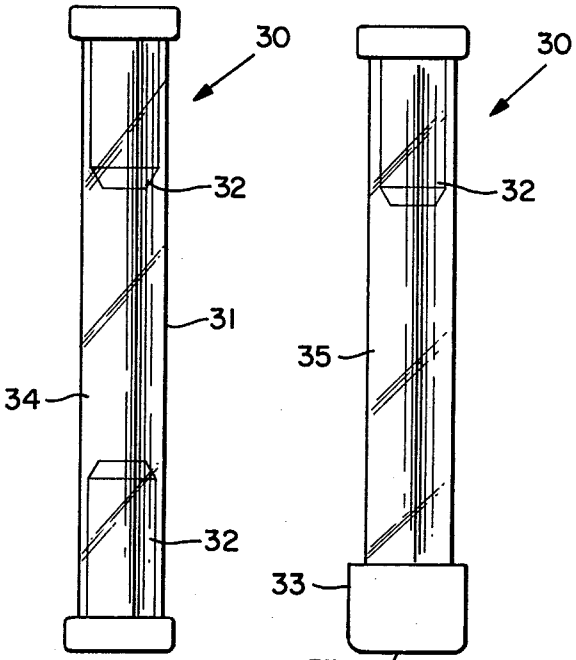
FIG. 3A
FIG. 3B
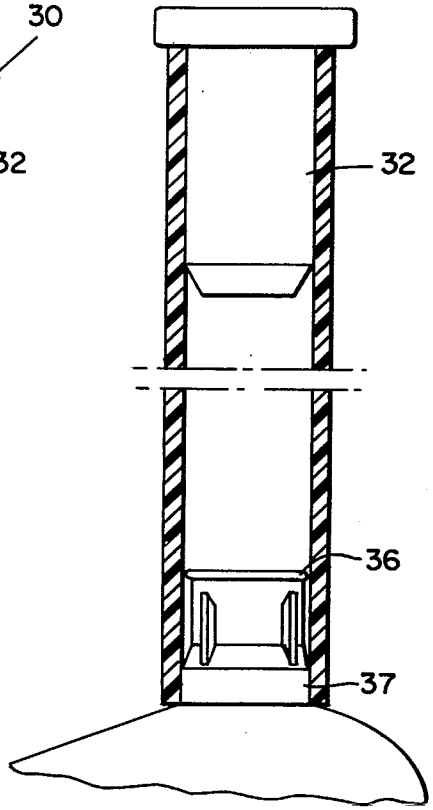
FIG. 4

PHARMACEUTICAL DELIVERY SYSTEM

This is a continuation, of application Ser. No. 818,042 filed July 22, 1977 which in turn is a Continuation of U.S. Ser. No. 615,450, filed Sept. 22, 1975, both abandoned.

The aim of bronchodilation therapy is to reduce abnormally high airway resistance which is most often accomplished by the administration of adrenergic drugs among which are isoproterenol, phenylephrine, racemic epinephrine, and ephedrine. Generally, these drugs are given as aerosols in powered nebulizers or intermittent positive pressure breathing apparatus (IPPB). The usual dose is 0.5 - 1.0 ml of 1 : 200 isoperterenol or 2.25% racemic epinephrine is diluted in enough saline or water (2–5 ml) to assure aerosol therapy for 5 - 10 minutes.

Most hospitals utilize a multi-dose method of IPPB therapy in which multi-dose vials of sterile saline or water are carried by the technician to the administration site. A prescribed amount of liquid is then withdrawn from the multi-dose vial by use of a presterilized disposable syringe. In theory, a new syringe and needle are used for each patient. The liquid is withdrawn from the container into the syringe and then expressed into the nebulizer reservoir. The active ingredient, such as isoproternol, Bronkosol$^{tm}$, is added to the reservoir by means of a measuring dropper supplied with the drug bottle or drawn up from the drug bottle by a single sterile syringe. In any case, the same bottles are taken from hospital room to hospital room enhancing the possibility of cross contamination and loss of sterility.

It is an object of the present invention to overcome the possibility of contamination of aerosol solutions.

Another object of the present invention is to afford a novel drug delivery system wherein the parts of the system are arranged in a novel and expeditious manner to allow a bronchial dilator solution to easily be administered to the nebulizer reservoir of an IPPB apparatus.

Another object of the present invention is to afford a novel transparent calibrated bottle which permits accomodation of the variations found in physcian prescribing.

A further object of the present invention is to afford a novel drug containing capsule which insures thorough discharge in the desired direction, automatic mixing of the drug contained in the capsule with the diluent liquid contained in the transparent calibrated bottle, and thorough rinsing of the drug therein during the discharge operation.

Yet another object of the present invention is to afford a novel liquid containing bottle which is easily opened with a one handed operation and wherein the neck of the bottle is so designed so as to be intimately attached to the capsule of this invention to complete the drug delivery package.

Another object of the present invention is to afford a novel drug delivery system which is practical and efficient in construction and operation and which may be readily and economically produced.

Other and further objects of the present invention will be apparent from the following description and claims which are illustrated in the accompanying drawings in which:

FIG. 1 is a front view of the liquid container dose bottle;

FIG. 2 is a side view of the bottle of FIG. 1;

FIG. 3A is a perspective view of the drug containing capsule according to the present invention;

FIG. 3B is a modification of the capsule shown in FIG. 3A;

FIG. 4 is a perspective view of the capsule of FIGS. 3A or B attached to the neck of the bottle of FIG. 1.

More particularly the molded deformable bottle 10 of the present invention has a generally oval cross-sectional shape and carries a downwardly extending tab 11 on which a control number, expiration date, or other information may be embossed. The bottle also carries graduations 18 by which to measure the volume of the fluid expressed through the capillary opening of the offset neck 15 at the top of the bottle.

The bottle opening is sealed by a closure seal 13 which comprises a lever arm 14 and a flat discoidal cover 19.

The neck is offset from the central axis of the bottle in such a manner that one shoulder of the bottle is longer than the other and this longer shoulder defines a downwardly tapered shoulder 12. The taper increases the spacing between the bottle and the lever arm so that when the bottle is grasped in one hand, the users thumb may be inserted in this space and by positioning the lever arm in the direction of the arrow, the closure may be broken and the top discarded. The seal-neck junction is so molded that once the seal is removed, a secondary sealing ring 36 is exposed.

The bottle neck is molded to comprise a number of ribs 16 which strengthen the neck and aid in guiding the dose capsule 30 over the bottle neck. The midportion of the neck comprises an outwardly extending shoulder sealing system 17 which is attached to large inner diameter dose capsules. The cylindrical portion 15 immediately adjacent the bottle is adapted to frictionally contact the inner surface of the capsule to form a primary seal 37.

The dose capsule is a hollow cylindrical capillary tube 31 having closure means 32 sealing both ends of the tube. These closures may extend into the tube as shown in FIG. 3A to form a central cavity 34 of a predetermined volume equal to the desired amount of the active ingredient. Alternatively, the capsule may be prepared as shown in FIG. 3B wherein the cavity 35 is under a vacuum and asceptically sealed by the closure means 32 and a cap 33 having a surface 33A intended to be punctured by a hypodermic needle. In this embodiment, the technician may prepare an active ingredient other than those listed and inject and store the preparation in the capsule until it is needed.

In use, the bottle containing the premeasured amount of diluent, such as water or saline, is grasped by the technician in one hand, the technician's thumb is inserted between the tapered shoulder and the lever arm and the closure top is positioned away, removed, and discarded. The liquid remains within the bottle since the internal diameter of the neck forms a capillary and requires the bottle to be squeezed in order to express the diluent.

The technician next removes one of the sealing means on the capsule and positions the open end over the bottle neck to form a friction fit. A primary 37 and a secondary 36 seal formed by the friction contact of the neck and capsule prevent liquid loss. By merely removing the remaining sealing means from the capsule, the unit can be inverted, the bottle squeezed and the contents of the capsule flushed into the IPPB nebulizer by the diluent in the bottle.

Thus, while I have illustrated and described the preferred embodiment of my invention, it is to be understood that this is capable of variation and modification, and I therefore do not wish to be limited to the precise terms set forth, but desire to avail myself of such changes and alterations which fall within the purview of the following claims:

I claim:

1. A single use container for antiseptic application of a pharmaceutically acceptable diluent, the container comprising a molded deformable translucent plastic bottle generally oval in cross-section and having a planar generally oval closed bottom portion and a generally oval closed top portion, said top portion having a hollow cylindrical neck extending upwardly therefrom and being located on the longitudinal axis and offset from the center of the oval top portion, said neck having integral closure means aseptically sealing the interior of the container from its environment, the closure means being discoidal in shape and having a greater diameter than the cross-sectional diameter of the neck the closure means being attached to the neck along a weakened portion at the junction of the neck and closure means, the closure means having integral bar means parallel to the generally oval bottom portion of said container and extending along a plane passing through the longitudinal diameter of the container's cross section for removing the closure from the neck about said weakened junction, said container further having an integral tab extending downwardly from the bottom portion and extending completely across the bottom portion along the longitudinal diameter of the generally oval cross section, wherein the exterior of said bottle contains raised portions extending parallel to said bottom portion and aligned longitudinally along said exterior, said raised portions functioning to represent graduations whereby the volume of any material within the container may easily be ascertained, said neck of the container being offset from the central axis of the bottle defining opposite shoulders extending from the neck to the outer most generally oval cross-section of said container in such a manner that the shoulder extending in the same direction as the bar means is longer than the remaining shoulder, said neck further having integral primary sealing means located at the junction of said container and neck portion and secondary sealing means located at the upper most portion of said neck and being exposed after the closure means is removed from said neck portion wherein the primary and secondary sealing means cooperates with an open ended hollow cylindrical pharmaceutical unit dose package when said package and container are attached for use.

2. A single use container for antiseptic application of a pharmaceutically acceptable diluent, the container comprising a molded deformable translucent plastic bottle generally oval in cross-section and having a planar generally oval closed bottom portion and a generally oval closed, top portion, said top portion having a hollow cylindrical neck extending upwardly therefrom and being located on the longitudinal axis of the oval top portion, said neck having integral closure means aseptically sealing the interior of the container from its environment, the closure means being discoidal in shape and having a greater diameter than the cross-sectional diameter of the neck the closure means being attached to the neck along a weakened portion at the junction of the neck and closure means, the closure means having integral removal means, extending generally along a plane passing through the longitudinal diameter of the container's cross section for removing the closure from the neck about said weakened junction, said container further having raised portions extending parallel to said bottom portion and aligned longitudinally along said exterior, said raised portions functioning to represent graduations whereby the volume of any material within the container may easily be ascertained, said container having opposite downwardly tapered shoulders extending from the base of the neck to the outer most generally oval cross section of said container said neck further having integral primary sealing means located in the junction of said container and neck portion and secondary sealing means located at the upper most portion of said neck and exposed after the closure means is removed from said neck portion wherein the primary and secondary sealing means cooperates with an open ended hollow cylindrical pharmaceutical unit dose package when said package and container are attached for use.

3. A unit dose pharmaceutical delivery system comprising:

An open ended pharmaceutical unit dose package comprising a hollow cylindrical tube containing a liquid bronchodilator composition selected from the group consisting of isoproternol, phenylephrine, racemic epinephrine, and epinephrine within a cavity and having a removable first sealing means at each end of the tube, each of said first means having a portion extending into the tube and defining said cavity having a predetermined volume equal to the desired unit dose of the bronchodilator to the exclusion of an air space and wherein the sealing means is in intimate frictional contact between the interior of the tube and the entire portion of the first sealing means extending into the tube, said contact comprising an air tight seal; and a single use container for antiseptic application of a pharmaceutically acceptable diluent, the container comprising a molded deformable translucent plastic bottle generally oval in cross-section and having a planar generally oval closed bottom portion and a generally oval closed top portion, said top portion having a hollow cylindrical neck extending upwardly therefrom and being located on the longitudinal axis and offset from the center of the oval top portion, said neck having integral closure means aseptically sealing the interior of the container from its environment, the closure means being discoidal in shape and having a greater diameter than the cross-sectional diameter of the neck the closure means being attached to the neck along a weakened portion at the junction of the neck and closure means, the closure means having integral bar means parallel to the generally oval bottom portion of said container and extending along a plane passing through the longitudinal diameter of the container's cross section for removing the closure from the neck about said weakened junction, said container further having an integral tab extending downwardly from the bottom portion and extending completely across the bottom portion along the longitudinal diameter of the generally oval cross section, the neck having integral primary sealing means located in the junction of said container and neck portion and secondary sealing means located at the upper most portion of said neck and exposed after the closure means is removed from said neck portion wherein the primary and secondary sealing means cooperates with the open ended pharmaceutical unit dose package when one of said removable sealing means at one end of said package is removed and said package and container are attached for use.

4. A unit dose pharmaceutical delivery system comprising:

An open ended pharmaceutical unit dose package comprising a hollow cylindrical tube containing a liquid bronchodilator composition selected from the group consisting of isoproternol, phenylephrine, racemic epinephrine, and epinephrine within a cavity and having removable first sealing means at each end of the tube, each of said first means having a portion extending into the tube and defining said cavity having a predetermined volume equal to the desired unit dose of the bronchodilator to the exclusion of an air space and wherein the sealing means is in intimate frictional contact between the interior of the tube and the entire portion of the first sealing means extending into the tube, said contact comprising an airtight seal; and A single use container for antiseptic application of a pharmaceutically acceptable liquid, the container comprising a molded deformable translucent bottle generally oval in cross section and having a flat, closed generally oval bottom portion and a closed generally oval top portion having a hollow neck extending upwardly therefrom said neck having integral secondary sealing means at its most proximal end and closure means at its most distal end whereby the container may be aseptically sealed from its environment, and wherein the closure means is a disc of greater diameter than the cross sectional diameter of the neck and which is attached to the neck along a weakened portion at the junction of said neck and disc, said disc further having an integral bar parallel to the generally oval bottom portion of said container and extending along a plane passing through the longitudinal diameter of the container's cross section, said container further having a tab extending downwardly from the bottom portion and extending completely across the bottom portion along the longitudinal diameter of the generally oval cross section, whereby said closure means is removed from the distal end of the neck by pressure upon the integral bar of the closure and whereby one end of the hollow cylindrical tube is attached after removal of one of said first sealing means to the neck of said container by friction fit insertion of the neck with the opened one end of the tube and wherein said tube engages with said secondary sealing means.

5. A unit dose pharmaceutical delivery system comprising:

An open ended pharmaceutical unit dose package comprising a hollow cylindrical tube containing a liquid bronchodilator composition within a cavity and having removable first sealing means at each end of the tube each of said first means having a portion extending into the tube and defining said cavity having a predetermined volume equal to the desired unit dose of the bronchodilator to the exclusion of an air space and wherein the sealing means is in intimate frictional contact between the interior of the tube and the entire portion of the first sealing means extending into the tube, said contact comprising an airtight seal; and A single use container for antiseptic application of a pharmaceutically acceptable diluent, the container comprising a molded deformable translucent plastic bottle generally oval in cross-section and having a planar generally oval closed bottom portion and a generally oval closed top portion, said top portion having a hollow cylindrical neck extending upwardly therefrom and being located on the longitudinal axis of the oval top portion, said neck having integral closure means aseptically sealing the interior of the container from its environment, the closure means being discoidal in shape and having a greater diameter than the cross-sectional diameter of the neck the closure means being attached to the neck along a weakened portion at the junction of the neck and closure means, the closure means having integral removal means, extending generally along a plane passing through the longitudinal diameter of the container's cross section for removing the closure from the neck about said weakened junction, said container further having raised portions extending parallel to said bottom portion and aligned longitudinally along said exterior, said raised portions functioning to represent graduations whereby the volume of any material within the container may easily be ascertained, said container having opposite downwardly tapered shoulers extending from the base of the neck to the outer most generally oval cross section of said container said neck further having integral primary sealing means located in the junction of said container and neck portion and secondary sealing means located at the upper most portion of said neck and exposed after the closure means is removed from said neck portion wherein the primary and secondary sealing means cooperates with an open ended hollow cylindrical pharmaceutical unit dose package when said package and container are attached for use.

* * * * *